US007404742B2

(12) United States Patent
Hyland et al.

(10) Patent No.: US 7,404,742 B2
(45) Date of Patent: Jul. 29, 2008

(54) METHOD AND APPARATUS FOR AN ELECTRICAL CONNECTOR WITH BINDING POSTS AND AN RJ CONNECTOR

(75) Inventors: Dwight Hyland, Seattle, WA (US); David Gibson, Everett, WA (US); Jim Curtin, Seattle, WA (US); Yohay Hahamy, Buffalo Grove, IL (US)

(73) Assignee: Fluke Corporation, Everett, WA (US)

( * ) Notice: Subject to any disclaimer, the term of this patent is extended or adjusted under 35 U.S.C. 154(b) by 0 days.

(21) Appl. No.: 11/633,983

(22) Filed: Dec. 4, 2006

(65) Prior Publication Data

US 2008/0132126 A1 Jun. 5, 2008

(51) Int. Cl.
*H01R 25/00* (2006.01)

(52) U.S. Cl. ..... 439/638

(58) Field of Classification Search ..... 439/638, 439/655, 810, 727, 801
See application file for complete search history.

(56) References Cited

U.S. PATENT DOCUMENTS

| | | | | | |
|---|---|---|---|---|---|
| 1,697,237 | A | * | 1/1929 | Greene | 361/306.1 |
| 1,735,856 | A | * | 11/1929 | Greene | 361/306.1 |
| 4,911,655 | A | * | 3/1990 | Pinyan et al. | 439/412 |
| 5,167,526 | A | * | 12/1992 | Pinyan et al. | 439/411 |
| 5,687,213 | A | * | 11/1997 | Larkin | 379/21 |

* cited by examiner

*Primary Examiner*—Phuong K Dinh
(74) *Attorney, Agent, or Firm*—Dorsey & Whitney LLP

(57) ABSTRACT

Embodiments of the invention describe an electrical audio connector assembly used in a variety of applications, such as for connecting audio components for transferring audio signals. For example, microphones may be connected to other electrical components by XLR connectors or a phone line. An electrical audio connector assembly includes an XLR connector or three pins and an RJ connector mounted on opposite ends of a body structure. Three metal binding posts project from the body structure, and are conductively coupled to both the XLR connector and the RJ connector.

13 Claims, 7 Drawing Sheets

METHOD AND APPARATUS FOR AN ELECTRICAL CONNECTOR WITH BINDING POSTS AND AN RJ CONNECTOR

TECHNICAL FIELD

This invention relates to electrical connection devices, and more particularly to an electrical connector assembly that includes binding posts, an XLR connector and a registered jack ("RJ") connector to connect to a phone line.

BACKGROUND OF THE INVENTION

Various types of electrical connectors are used for a wide variety of applications. Particularly common in the professional audio industry is the use of binding posts with XLR plugs for connecting audio components to transfer audio signals.

Conventional binding posts generally provide reasonably good surface area contact for reliable conductivity. Binding posts are versatile terminals, and may accept banana plugs, alligator clips, bare wires, spade lugs or other electrical connections. The XLR plug in a conventional binding post assembly is an added feature that enables a number of cables to be coupled together to achieve any desired length. XLR connectors are widely used for audio connections because they provide balanced lines capable of traveling long distances without significant interference.

A conventional XLR binding post assembly 100 is shown in FIG. 1A. The conventional assembly 100 consists of three binding posts 114 corresponding to the three conductive wires found in standard XLR three pin connectors. A male-type XLR plug 130 is found at the base of the assembly 100. Although not shown, the assembly 100 may instead have a female-type XLR plug. Industry standard XLR binding posts come in either male or female types, to enable the connection of the three conductive wires between one XLR connector to a complementary connector. Each binding post 114 includes an internal metal post 120 capped by a plastic cover. The binding posts 114 are typically color-coded to indicate high, low and ground terminals. The internal metal post 120 includes a through-hole for receiving bare wire connections. Each internal metal post 120 is mounted on a metal platform 122 with a plastic external cover. The metal posts 120 are internally coupled to the corresponding conductive pins of the XLR plug 130 within the body structure. The entire assembly 100 is housed by a protective ABS plastic case.

In the professional audio industry, situations arise where it is necessary to access a phone line for various purposes. For example, microphones are commonly connected to other electrical components by either using XLR connectors or phone lines. Professional microphones in particular may need to be connected to various electrical devices and tested over long distances. A user may want the option of connecting the microphone through a phone jack or may need access to a phone in a remote location to communicate to others during testing. Typically, the user must then extend a separate phone line to that location, which is often cumbersome and time consuming. Having access to phones, however, is common practice in the audio industry, and with a phone users are able to conveniently "ring down" to another phone at the remote location.

Another drawback to the conventional XLR binding post is when bare wires 132 are received by the assembly 100, they must be threaded through the through-hole of each metal posts 120, as demonstrated in FIG. 1B, and clamped down by tightly twisting down the cap on the binding post 114. The assembly 100 of FIG. 1B is the same as the assembly 100 of FIG. 1A, and in the interest of brevity it will not be described again. XLR binding posts are typically manufactured with the through-hole centered on the internal metal posts 120. A common problem with this assembly 100 occurs when the bare wires 132 are guillotined as the binding post 114 caps are tightly screwed down. The through-hole is elevated above the metal platform 122 due its orientation in the metal post 120, which typically cause the bare wires 132 to stretch and break as the caps on the binding posts 114 are tightened. This is particularly a problem if the threaded wires 132 are phone wires, since phone wires are typically thinner.

There is therefore a need for an XLR binding post assembly having a phone jack for connecting to phone lines on a single device. Additionally, the XLR binding post assembly must be able to receive particularly thin wires without inflicting severe damage or causing breakage.

SUMMARY OF THE INVENTION

The invention is directed to an electrical audio connector assembly having an XLR connector and an RJ connector. In one aspect of the invention, a plastic body of the connector assembly houses two or more metal binding posts. The XLR connector and the RJ connector are both conductively coupled to at least one of the binding posts. The XLR connector is designed to connect to complimentary terminals of another connector for transferring electrical signals between the metal binding posts and any other attached connectors. The XLR connectors may be of the male or female type. The RJ connector is designed to connect to another RJ connector and transfer electrical signals between the metal binding posts and any other connectors.

In another aspect of the invention a method of manufacturing an electrical audio connector assembly with an attached XLR connector and RJ connector is disclosed. The method includes forming a plastic body structure around two or more metal binding posts. The method further includes attaching the XLR connector on one end of the plastic body structure and the RJ connector on the other end. The method also includes providing a conductive pathway between the XLR connector and the RJ connector to the metal binding posts. Screw caps are then attached to the metal binding posts.

DETAILED DESCRIPTION

Embodiments of the present invention are directed to an XLR binding post assembly and method for manufacturing the assembly having an RJ connector for connecting to phone lines. Certain details are set forth below to provide a sufficient understanding of the invention. However, it will be clear to one skilled in the art that the invention may be practiced without these particular details. In other instances, well-known circuits, control signals, and timing protocols have not been shown in detail in order to avoid unnecessarily obscuring the invention.

Figure 1A:
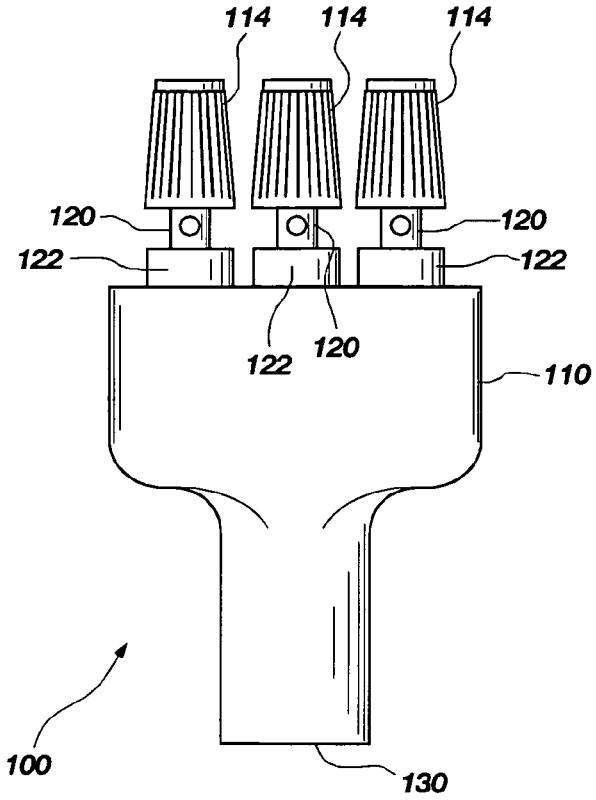
FIG. 1A (PRIOR ART)
FIG. 1A is a front elevational view of a conventional XLR binding post assembly.
Figure 1B:
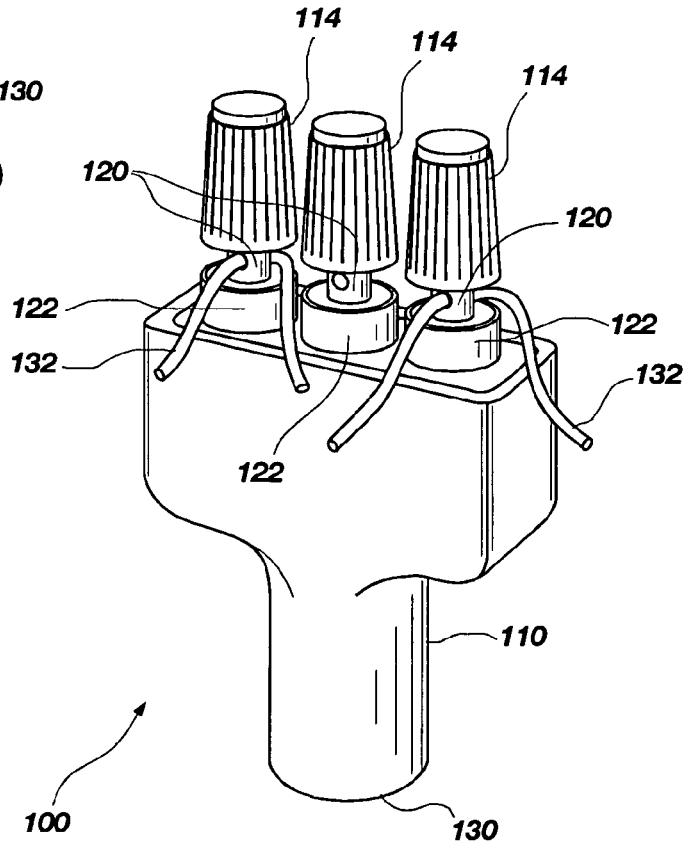
FIG. 1B (PRIOR ART)
FIG. 1B is an isometric view of a conventional XLR binding post assembly with threaded wires.
Figure 2A:
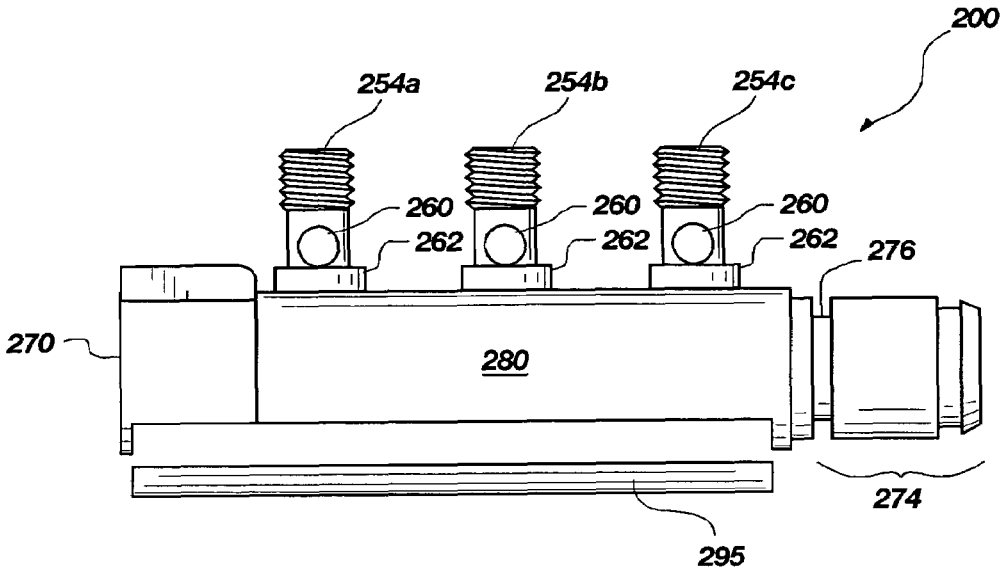
FIG. 2A is a side elevational view of a center structure of an XLR binding post assembly according to an embodiment of the invention.
Figure 2B:
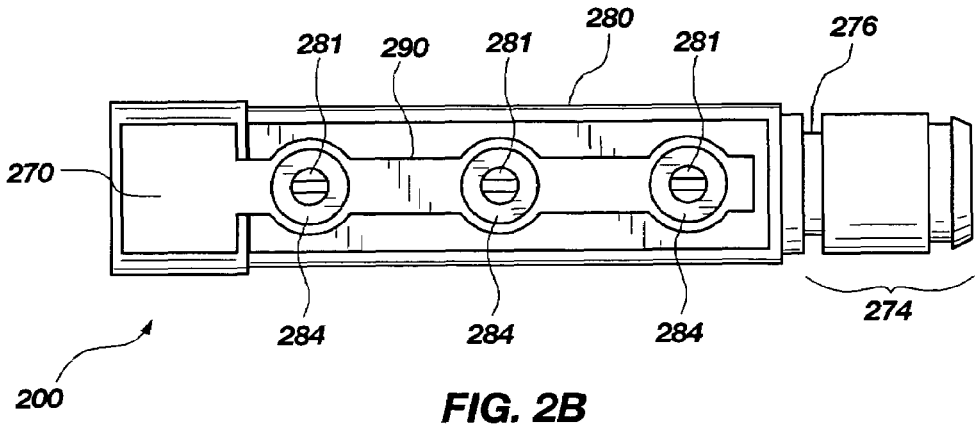
FIG. 2B is a bottom plan view of the center structure of an XLR binding post assembly according to an embodiment of the invention.

The center structure of an XLR binding post assembly 200 according an embodiment of the invention is shown in FIGS. 2A and 2B. A plastic body 280 houses three metal posts 254*a*-254*c* evenly mounted across the center region. The metal posts 254*a*-254*c* may be any type of metal that provides a the necessary conductivity, and includes nickel, aluminum, gold-plated metals and other metals. The top portion of the metal posts 254*a*-254*c* are threaded to attach plastic terminal screw caps. Each metal post 254*a*-254*c*, which includes a through-hole 260, are fitted through the plastic body 280. As previously described, the through-hole 260 is designed to receive and hold bare wires. The through-hole 260 is formed to be flush with a metal platform 262 in order to clamp bare wires threaded through the through-hole 260 without shearing them, as will be further described in later sections. The metal posts 254*a*-254*c* are laid through the plastic body 280 to provide a conductive path between external pins and wires to the internal wiring of the assembly 200. The assembly 200 also includes a plastic casing 270 on one end for an RJ connector, and an insertion point 274 with an O-ring groove 276 on the other end for attaching either a male or female XLR connector. Any internal wiring through the plastic body 280 is confined to the underside of the assembly 200, and will be described in detail next. A plastic cover 295 is then placed over the internal wiring on the underside of the assembly 200 to provide protection, and also gives the body 280 a cylindrical shape. Although the preferred embodiment of the body 280 is cylindrical, other body shapes and types may be used.

FIG. 2B is a bottom plan view of the same assembly 200 of FIG. 2A. The underside of the assembly 200 is shown without the plastic cover 295 that fits over the underside region. A metal base 284 corresponding to each of the metal posts 254*a*-254*c* appear along the underside region. Each metal base 284 includes a protruding metal center stud 281 with a rectangular groove formed across its center to easily connect and solder wires to each of the metal posts 254*a*-254*c*. The metal bases 284 are encompassed by a plastic wire channel 290 that spans across the horizontal plane of the underside region. The plastic wire channel 290 opens into the RJ connector plastic casing 270. The plastic wire channel 290 also extends to the XLR insertion point 274 through a small opening, and provides a place for laying internal wires coupled to the metal posts 254*a*-254*c* and to the pins of the XLR connector, or alternatively to the RJ connector. Once the wires are laid, the plastic cover 295 is then placed over the region of the plastic wire channel 290.

Figure 3A:
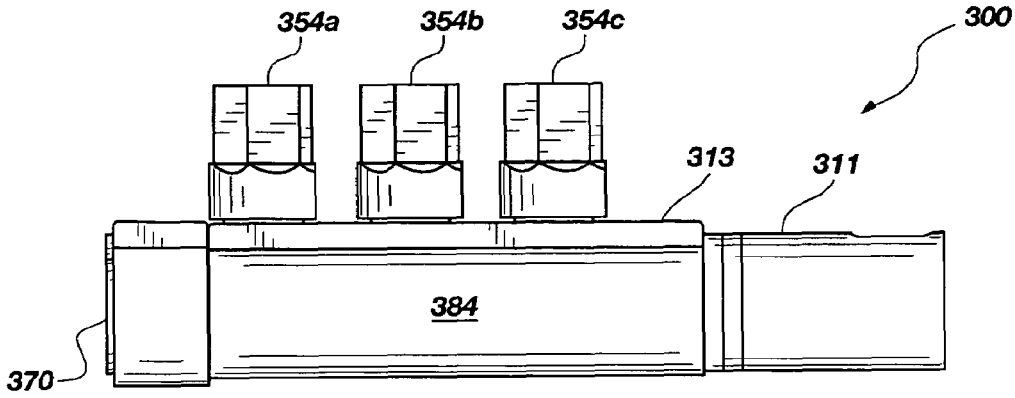
FIG. 3A is a side elevational view of an XLR binding post assembly according to an embodiment of the invention.

FIG. 3A is a side elevational view of a complete XLR binding post assembly 300 according to an embodiment of the invention. A male XLR connector 311 is attached to one end of the assembly 200, and an RJ connector 370 is attached to the other end. The internal structure of each connector will be described further later. A protective plastic overcoat covers the entire body structure 384 of the assembly 200. Binding posts 354*a*-354*c* include a plastic terminal screw cap that screws on each of the metal posts 254*a*-254*c* of FIGS. 2A and 2B. The tops of the terminal screw caps 354*a*-354*c* are open to expose the hollow centers of the metal posts 254*a*-254*c* so that the binding posts 354*a*-354*c* may receive banana plugs, alligator clips, spade lugs or other electrical connections. The terminal screw caps may be color-coded with different colors to indicate the type of terminal it is, such as high, low or ground.

Figure 3B:
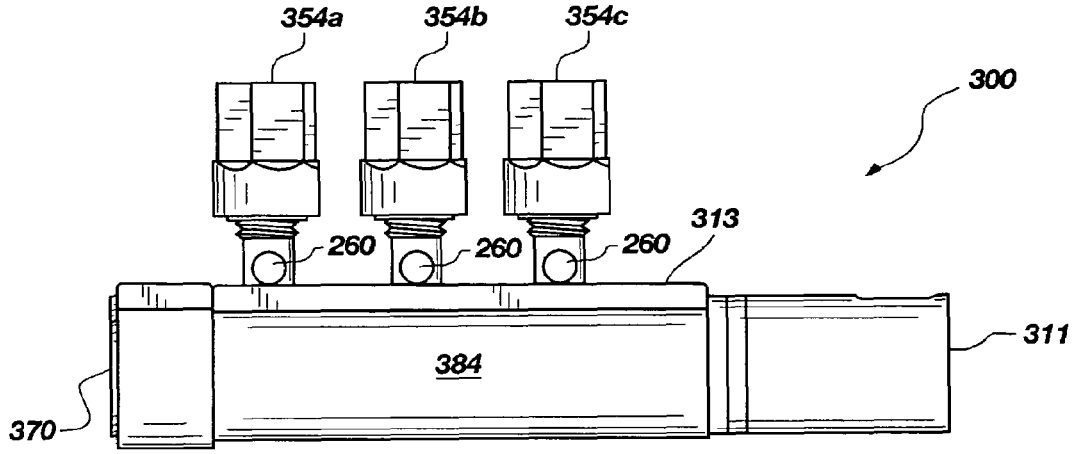
FIG. 3B is a side elevational view of an XLR binding post assembly according to another embodiment of the invention.

As previously described, wires may be threaded through the through-holes 260 of the binding posts 354*a*-354*c*, shown in FIG. 3B. The terminal screw caps of the binding posts 354*a*-354*c* are unscrewed to expose the through-holes 260. Once the wires are threaded through, they are held in place by screwing the caps back down. The binding posts 354*a*-354*c* are confined by a slightly elevated platform 313 that rises to the level of the through-holes 260 to provide a leveled planar surface for supporting the threaded wires. Since the through-holes 260 are flush with the platform 313, the wire may be clamped in place, and not bent or sheared as the screw caps are tightened.

Figure 3C:
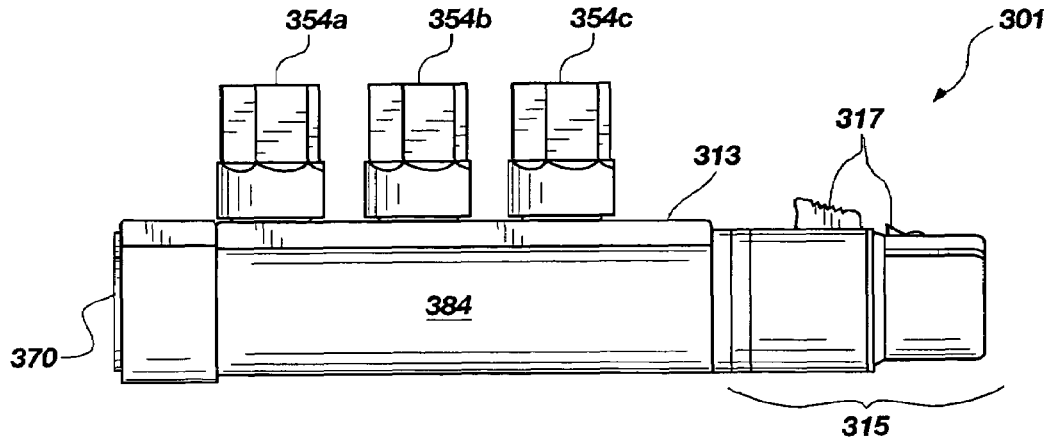
FIG. 3C a side elevational view of an XLR binding post assembly according to another embodiment of the invention.

A female XLR binding post assembly 301 is shown in FIG. 3C having essentially the same configuration as the male XLR assembly 300. In the interest of brevity, elements that are the same will not be described again. The female XLR assembly 301 further includes a female connector 315 attached to the plastic body structure 384 instead of the male XLR connector 311. The female connector 315 additionally includes having standard metal clasps 317 for fastening to complimentary male connectors. The male XLR connectors 311 typically includes a gap or hole (not shown) on its external rim, for receiving the metal clasps 317 of the female XLR connector 315. One of the metal clasps 317 locks complimentary connectors together, while the other releases them.

Figure 4A:
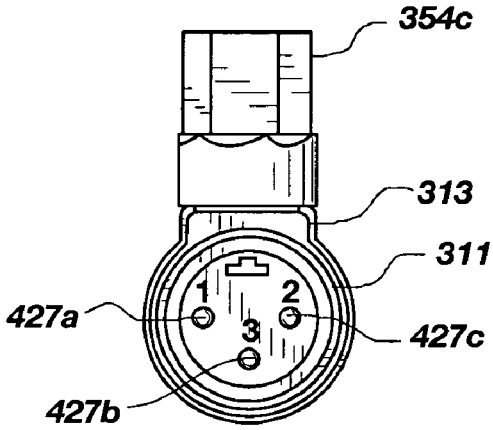
FIG. 4A is a front elevational view of a male XLR connector according to an embodiment of the invention.
Figure 4B:
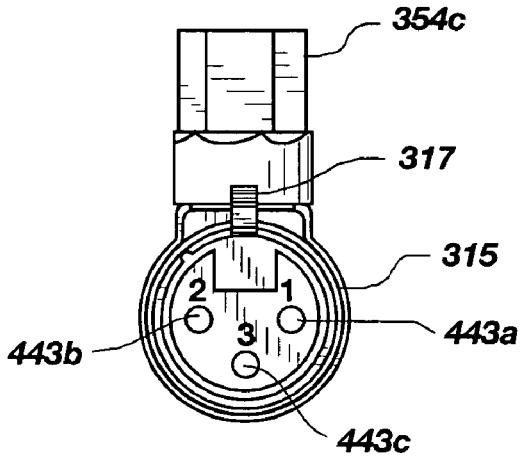
FIG. 4B is a front elevational view of a female XLR connector according to another embodiment of the invention.
Figure 4C:
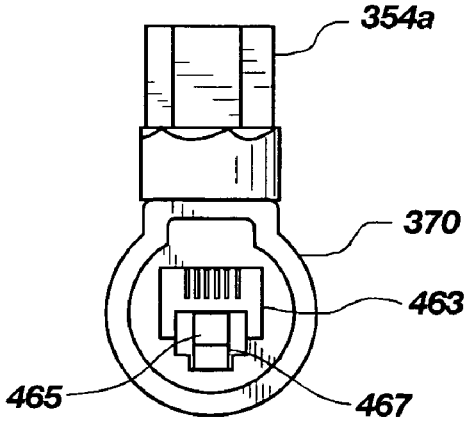
FIG. 4C is a rear elevational view of an RJ connector binding post assembly according to an embodiment of the invention.

FIGS. 4A, 4B and 4C show the front elevational views of a male XLR connector 311, female XLR connector 315 and an RJ connector 370, respectively. The male and female XLR connectors are industry-standard three pin connectors, as previously describe. The male XLR connector of FIG. 4A has a first metal pin 427*a*, a second metal pin 427*b* and third metal pin 427*c* protruding from the internal plastic body 280 of the assembly 300. The pins 427*a*-427*c* are shielded by the protective plastic overcoat of the male XLR connector 311 component. The metal pins 427*a*-427*c* are internally wired to respective binding posts 354*a*-354*c*, as already described. From this view, the binding post 354*c* and the bind post platform 313 are also seen. The female XLR connector 315 has three pin holes 443*a*-443*c*, embedded in the internal plastic body of the female XLR connector 315, for receiving corresponding pins 427*a*-427*c* of the male XLR connector 311. From this view, the binding post 354*c* and the connecting clips 317 are also seen.

The internal structure of the RJ connector 370 is shown in FIG. 4C. The RJ connector 370 is housed on the end opposite the XLR connectors 311, 315, and from this view the binding post 354*a* is seen. A standard RJ plug 463 is embedded into the plastic-filled casing of the RJ connector 370. The RJ connector 370 is also internally wired to the binding post as already described. Two electrical pins 465, 467 are wired from two of the binding posts 354*a*-354*c* and installed in the RJ plug 463 for connecting to an external phone line. Although the preferred embodiment uses the standard 6-position RJ plug 463, other connectors such as the 8-position connectors may also be installed.

Figure 5:
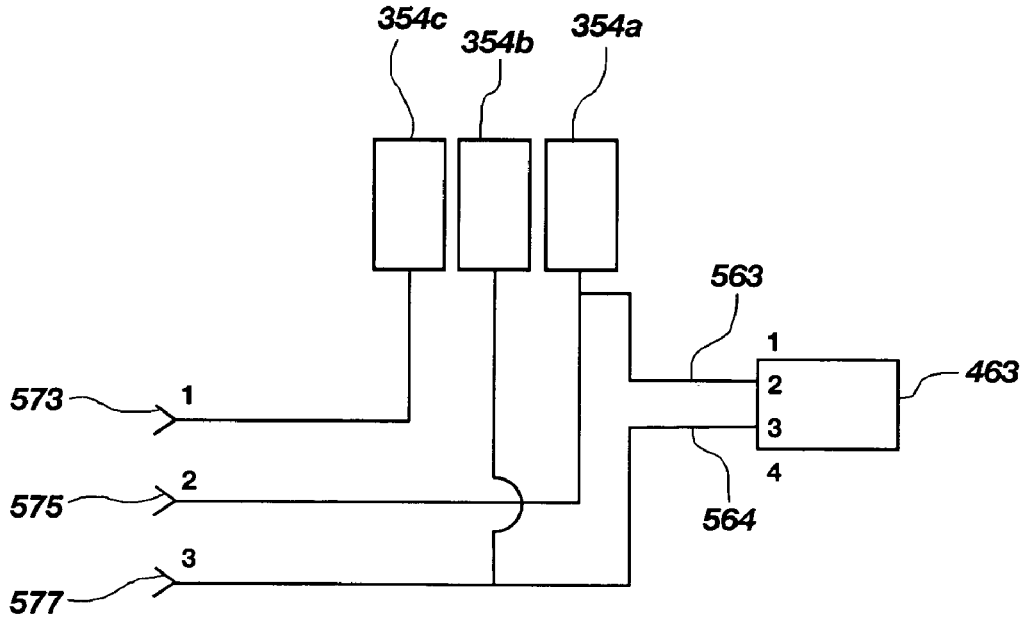
FIG. 5 is a schematic drawing of the binding posts electrically connected to the RJ connector according to an embodiment of the invention.

FIG. 5 is a schematic drawing that may represent the internal electrical connection of the binding posts 254*a-c* to the RJ connector 463 in the plastic casing 270 and the XLR connectors 427, 433 in the XLR insertion point 274 of the XLR binding post assembly 200 in FIG. 2A. As shown in FIG. 5, the ends of the binding posts 354*a*-354*c* are connected to respective XLR pins 573, 575, 577. For example, the binding post 354*a* is internally coupled to the XLR pin 575, which connects to pin 2 of an external XLR connector. Each of the binding posts 354*a*-354*c* are internally wired to each of the XLR pins 573, 575, 577. Similarly, the RJ plug 563 is also internally wired to the binding posts 573, 575, 577. Since RJ plug 563 requires only two pins 563, 564, only two of the binding posts 354*a*, 354*b* are assigned.

Figure 6:
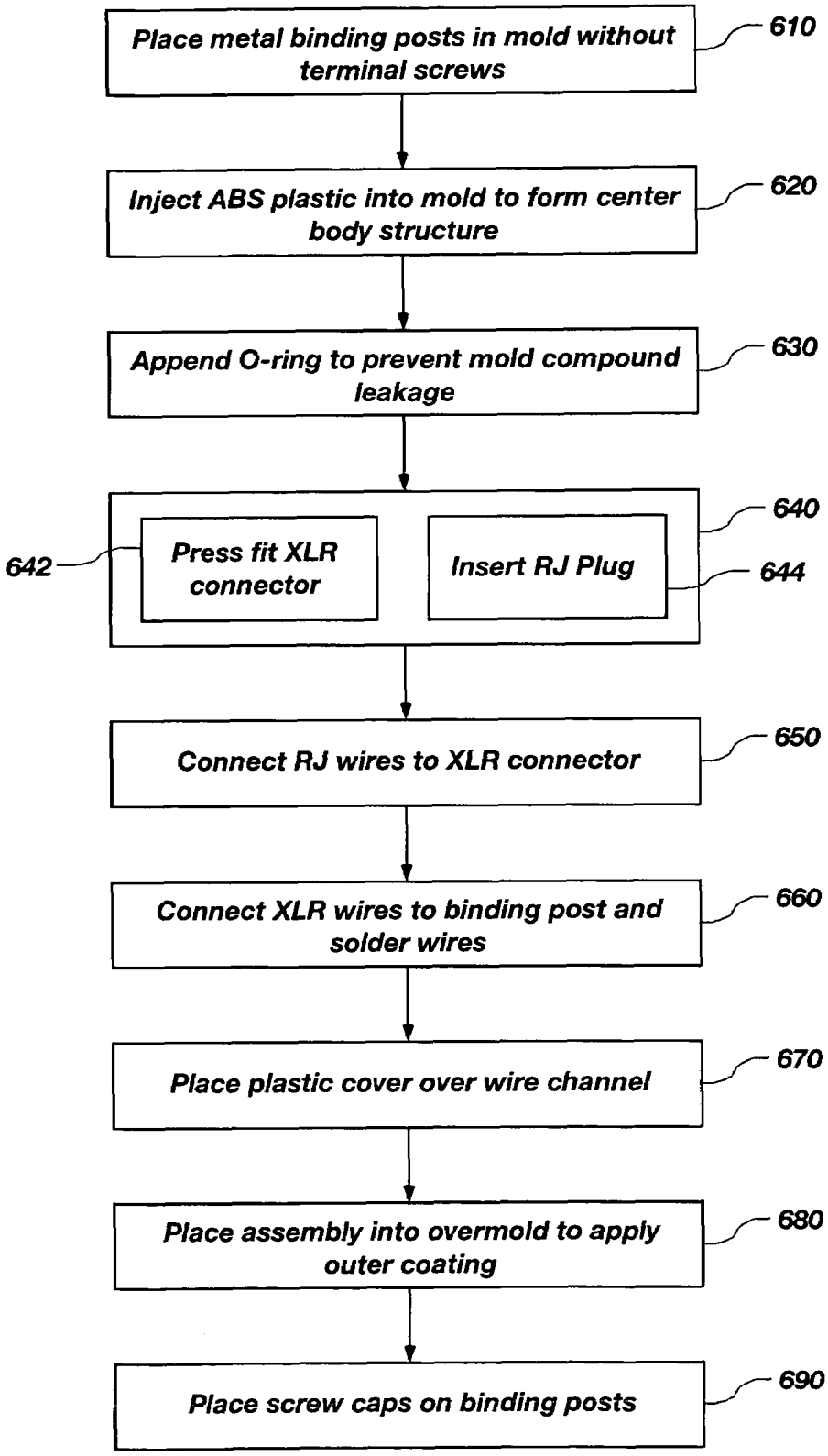
FIG. 6 shows a method for manufacturing an XLR binding post assembly according to an embodiment of the invention.

FIG. 6 shows a method for manufacturing the XLR binding post assembly 300 of FIGS. 2A-2B and 3A-3C according to an embodiment of the invention. At step 610, metal posts 254*a*-254*c* are placed, without the terminal screws, in a predetermined product mold to form the cylindrical plastic body 280. At step 620, an ABS plastic is injected into the product mold, which forms the plastic body 280. ABS plastic is the preferred material for molding the center plastic body 280, but other industrial plastic compounds or other materials may be used instead. The plastic body 280 is formed to include the O-ring groove 276 for appending an O-ring, at step 630, prior to attaching the connectors. The O-ring prevents the mold compound from leaking, when the assembly 300 is later placed into an overmold and injected with an outer coating material at step 680. Step 644 includes the substeps 642 and 644 in no particular order. At substep 642, a metal piece of the XLR connector 311, 315 is press fit on the plastic body 280, and keyed so that the pins are correctly aligned. At substep 644, an RJ connector 370 is inserted on the other end of the plastic body 280. The RJ wires are connected to the XLR connector pins 573, 575, 577 at step 650. The wires to the XLR connector pins 573, 575, 577 are then coupled to the binding posts 354*a*-354*c* at step 660, and the wires are soldered onto the metal studs 281 at the base of the metal posts 284. At step 670, the plastic cover 295 is placed over the wire channel 290 after the wires have been correctly oriented. The entire center assembly 200 is then placed into the overmold at step 680, and the outer plastic coating is applied. The attached O-ring from step 630 is in place to prevent any of the injected coating material from leaking out. At step 690, the plastic screws are placed on the binding posts 354*a*-354*c* to fabricate the complete the assembly 300.

Figure 7:
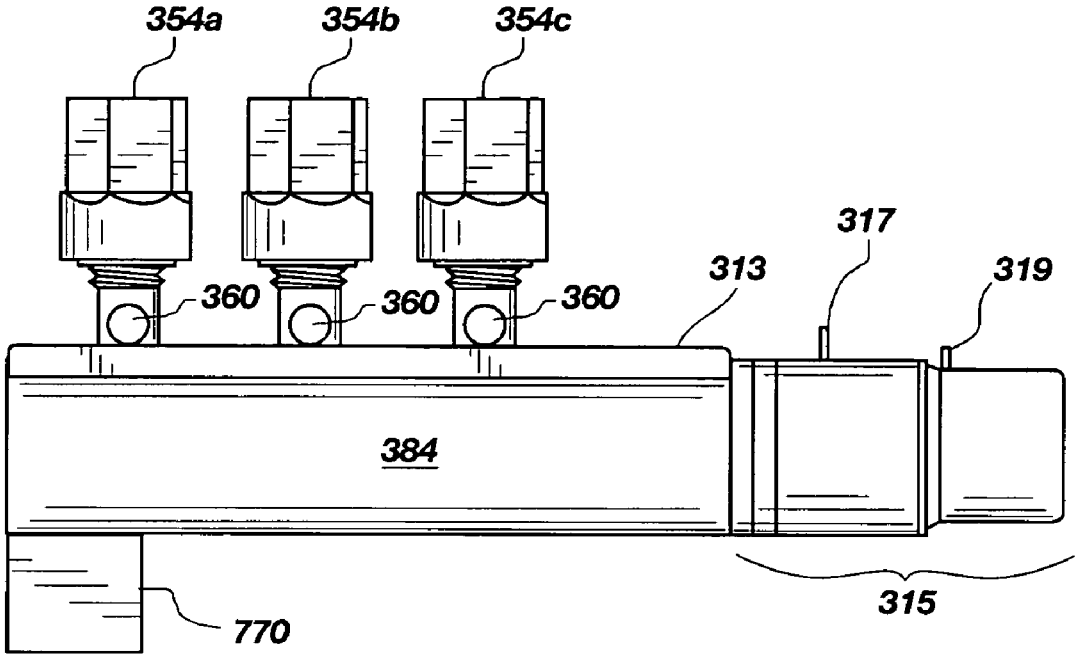
FIG. 7 is an isometric view of an XLR binding post assembly according to another embodiment of the invention.

FIG. 7 is an isometric view of an XLR binding post assembly 700 according to an alternate embodiment of the invention. The assembly 700 essentially includes parts and elements of the assembly 300 of FIGS. 3A-3C, and in the interest of brevity, these common parts will not be described again. The assembly 700 in this embodiment includes an RJ connector 770, positioned orthogonal to the plastic body structure 384.

Although the present invention has been described with reference to the disclosed embodiments, persons skilled in the art will recognize that changes may be made in form and detail without departing from the spirit and scope of the invention. Such modifications are well within the skill of those ordinarily skilled in the art. Accordingly, the invention is not limited except as by the appended claims.

We claim:

1. An electrical audio connector assembly, comprising;

at least two metal posts structured to have a hole through each, the hole through each metal post being flush with a flat portion of the body;

a body structured to house the at least two metal posts;

an XLR connector mounted to the body and conductively coupled to the at least two metal posts, the XLR connector being structured to transfer electrical signals to and from the at least two metal posts; and a registered jack ("RJ") connector mounted to the body and conductively coupled to the XLR connector and the at least two metal posts.

2. The electrical audio connector assembly of claim 1 wherein the at least two metal posts comprises at least two binding posts configured to receive external connectors, including banana plugs, alligator clips, bare wires and spade lugs.

3. The electrical audio connector assembly of claim 1 wherein the XLR connector further comprises a three-pin male connector.

4. The electrical audio connector assembly of claim 1 wherein the RJ connector comprises an RJ11 plug.

5. The electrical audio connector assembly of claim 1 wherein the body comprises ABS plastic.

6. The electrical audio connector assembly of claim 5 wherein the body comprises a cylindrical shape, and further comprises the XLR connector and the RJ connector positioned in line with the cylindrical shaped body.

7. The electrical audio connector assembly of claim 1 further comprising an outer cover coating.

8. An electrical connector, comprising:

a body structure;

a raised planar surface atop the body structure;

at least two metal posts projecting from the planar surface of the body structure, the at least two metal posts further comprising;

a hole boring through the metal of the at least two metal post, the hole boring through the metal being flush with the raised planar surface for receiving wires level to the planar surface;

a threaded screw top for receiving a binding cap that screws onto each metal post, the binding caps structured to screw down and clamp the received wires without guillotining the received portion of the wires.

9. The electrical connector of claim 8 wherein the at least two metal posts are further configured to receive external connectors, including banana plugs, alligator clips, bare wires and spade lugs.

10. The electrical connector of claim 9 wherein the at least two binding posts further comprises a terminal for ground, a terminal for a high signal and a terminal for a low signal.

11. The electrical connector of claim 8 further comprising an XLR connector having a three-pin connector.

12. The electrical connector of claim 8 further comprising an RJ connector having an RJ11 plug.

13. The electrical connector of claim 8 wherein the body structure comprises ABS plastic.

* * * * *